US006236007B1

(12) United States Patent
Ho

(10) Patent No.: US 6,236,007 B1
(45) Date of Patent: May 22, 2001

(54) ROTARY SWITCH FOR A TWO-WIRE ELECTRICAL CABLE

(75) Inventor: Hsien-Wen Ho, Tainan (TW)

(73) Assignee: Chi-Wen Chen, Taipei (TW)

( * ) Notice: Subject to any disclaimer, the term of this patent is extended or adjusted under 35 U.S.C. 154(b) by 0 days.

(21) Appl. No.: 09/635,678

(22) Filed: Aug. 10, 2000

(51) Int. Cl.[7] ..... H01H 19/14
(52) U.S. Cl. ..... 200/564; 200/571
(58) Field of Search ..... 200/564, 571, 200/11 R, 314

(56) References Cited

U.S. PATENT DOCUMENTS 3,892,931 * 7/1975 Lockard ..... 200/11 R
5,905,238 * 5/1999 Hung ..... 200/314
6,051,801 * 4/2000 Wang ..... 200/571

* cited by examiner

*Primary Examiner*—Michael L. Gellner
*Assistant Examiner*—Nhung Nguyen
(74) *Attorney, Agent, or Firm*—Pillsbury Winthrop LLP

(57) ABSTRACT

A rotary switch includes a switch housing formed with a plurality of barriers. The barriers are formed with retention notches such that two wires of an electrical cable can be securely retained in the switch housing.

8 Claims, 5 Drawing Sheets

ROTARY SWITCH FOR A TWO-WIRE ELECTRICAL CABLE

BACKGROUND OF THE INVENTION

1. Field of the Invention

The invention relates to a rotary switch, more particularly to a rotary switch that can be retained securely on a two-wire electrical cable.

2. Description of the Related Art

Referring to FIGS. 1 and 2, a conventional rotary switch is shown to comprise a rectangular switch housing, a rotary dial 13, a rotary contact 17, and first and second conductive terminals 15, 16. The switch housing includes complementary upper and lower housing parts 11, 12. The rotary dial 13 is mounted rotatably in the switch housing, and has diametrically opposite edge portions that extend outwardly of the switch housing at opposite lateral sides of the latter. The rotary contact 17 is mounted on the rotary dial 13. A two-wire electrical cable 14 extends longitudinally through the switch housing. The electrical cable 14 includes first and second wires 141, 142. The second wire 142 has a split section to form first and second wire portions 143, 144 inside the switch housing. The first and second conductive terminals 15, 16 are mounted in the switch housing, and are disposed at opposite longitudinal end portions of the same. The first conductive terminal 15 has a wire connecting portion 152 that pierces through insulation at the first wire portion 143 to connect electrically therewith. The second conductive terminal 16 has a wire connecting portion 162 that pierces through insulation at the second wire portion 144 to connect electrically therewith.

When the rotary dial 13 is rotated to a first switch position, the rotary contact 17 is brought to connect electrically with spring arm portions 151, 161 of the first and second conductive terminals 15, 16, thereby permitting current flow through the electrical cable 14. When the rotary dial 13 is rotated to a second switch position, the rotary contact 17 is moved to disconnect the spring arm portions 151, 161, thereby interrupting current flow through the electrical cable 14.

In the aforesaid conventional rotary switch, the electrical cable 14 is retained in the switch housing solely by the first and second conductive terminals 15, 16. As such, when the electrical cable 14 is subjected to tensile forces, the electrical cable 14 can easily move relative to the first and second conductive terminals 15, 16, which can result in electrical shock in the event that current flows through the electrical cable 14.

SUMMARY OF THE INVENTION

Therefore, the main object of the present invention is to provide a rotary switch of the aforesaid type that can be retained securely on a two-wire electrical cable.

According to this invention, a rotary switch is adapted for use with a two-wire electrical cable that includes first and second wires. The first wire has a split section to form first and second wire portions. The rotary switch comprises a switch housing, a rotary dial, a rotary contact, and first and second conductive terminals.

The switch housing includes complementary upper and lower housing parts that are fastened to each other and that cooperate to confine a chamber. One of the housing parts has a base wall and a surrounding wall that extends in a transverse direction from a periphery of the base wall. The surrounding wall has opposite first and second end wall portions, and opposite first and second lateral wall portions that interconnect the first and second end wall portions. Said one of the housing parts has a longitudinal axis. The first and second end wall portions of the surrounding wall are respectively formed with first and second wire notches that are disposed on the longitudinal axis. The first wire notch includes a pair of first notch portions disposed on opposite sides of the longitudinal axis. The second wire notch includes a pair of second notch portions disposed on opposite sides of the longitudinal axis. One of the first notch portions is longitudinally aligned with one of the second notch portions relative to the longitudinal axis. The other one of the first notch portions is longitudinally aligned with the other one of the second notch portions relative to the longitudinal axis.

Said one of the housing parts further has first, second, third and fourth barriers that extend from the base wall in the transverse direction. The first barrier is parallel to the first end wall portion of the surrounding wall, and is spaced apart from the first end wall portion along the longitudinal axis. The first barrier is formed with a first retaining notch that is disposed closer to the first lateral wall portion of the surrounding wall than the longitudinal axis, and a second retaining notch that is disposed closer to the second lateral wall portion of the surrounding wall than the longitudinal axis. The second barrier is parallel to the second end wall portion of the surrounding wall, and is spaced apart from the second end wall portion along the longitudinal axis. The second barrier is formed with a third retaining notch that is disposed closer to the first lateral wall portion than the longitudinal axis, and a fourth retaining notch that is disposed closer to the second lateral wall portion than the longitudinal axis. The third barrier is parallel to the first barrier, is spaced apart from the first barrier along the longitudinal axis, and is disposed between the first and second barriers. The third barrier is formed with a fifth retaining notch that is disposed closer to the second lateral wall portion than the longitudinal axis. The fourth barrier is parallel to the second barrier, is spaced apart from the second barrier along the longitudinal axis, and is disposed between the second and third barriers. The fourth barrier is formed with a sixth retaining notch that is disposed closer to the second lateral wall portion than the longitudinal axis.

One of the first notch portions and the first retaining notch are adapted to permit the first wire portion of the first wire of the electrical cable to extend therethrough and to permit subsequent bending of the first wire portion toward the longitudinal axis. The first and third barriers are adapted to clamp and retain the first wire portion therebetween. One of the second notch portions and the third retaining notch are adapted to permit the second wire portion of the first wire of the electrical cable to extend therethrough and to permit subsequent bending of the second wire portion toward the longitudinal axis. The second and fourth barriers are adapted to clamp and retain the second wire portion therebetween. The other one of the first notch portions, the second retaining notch, the fifth retaining notch, the sixth retaining notch, the fourth retaining notch and the other one of the second notch portions are adapted to permit the second wire of the electrical cable to extend therethrough.

The rotary dial is mounted rotatably in the chamber of the switch housing, and has an edge portion that extends outwardly of the switch housing. The rotary contact is mounted on the rotary dial, and is rotatable with the rotary dial between first and second switch positions. The first and second conductive terminals are mounted in the switch housing, and are disposed adjacent to the first and second end wall portions of the surrounding wall, respectively. The first conductive terminal has a wire connecting portion that is adapted to be connected electrically to the first wire portion, and a spring arm portion that extends toward the rotary dial. The second conductive terminal has a wire connecting portion that is adapted to be connected electrically to the second wire portion, and a spring arm portion that extends toward the rotary dial. The rotary contact connects electrically the first and second conductive terminals when the rotary contact is disposed in the first switch position, and disconnects the first and second conductive terminals when the rotary contact is disposed in the second switch position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
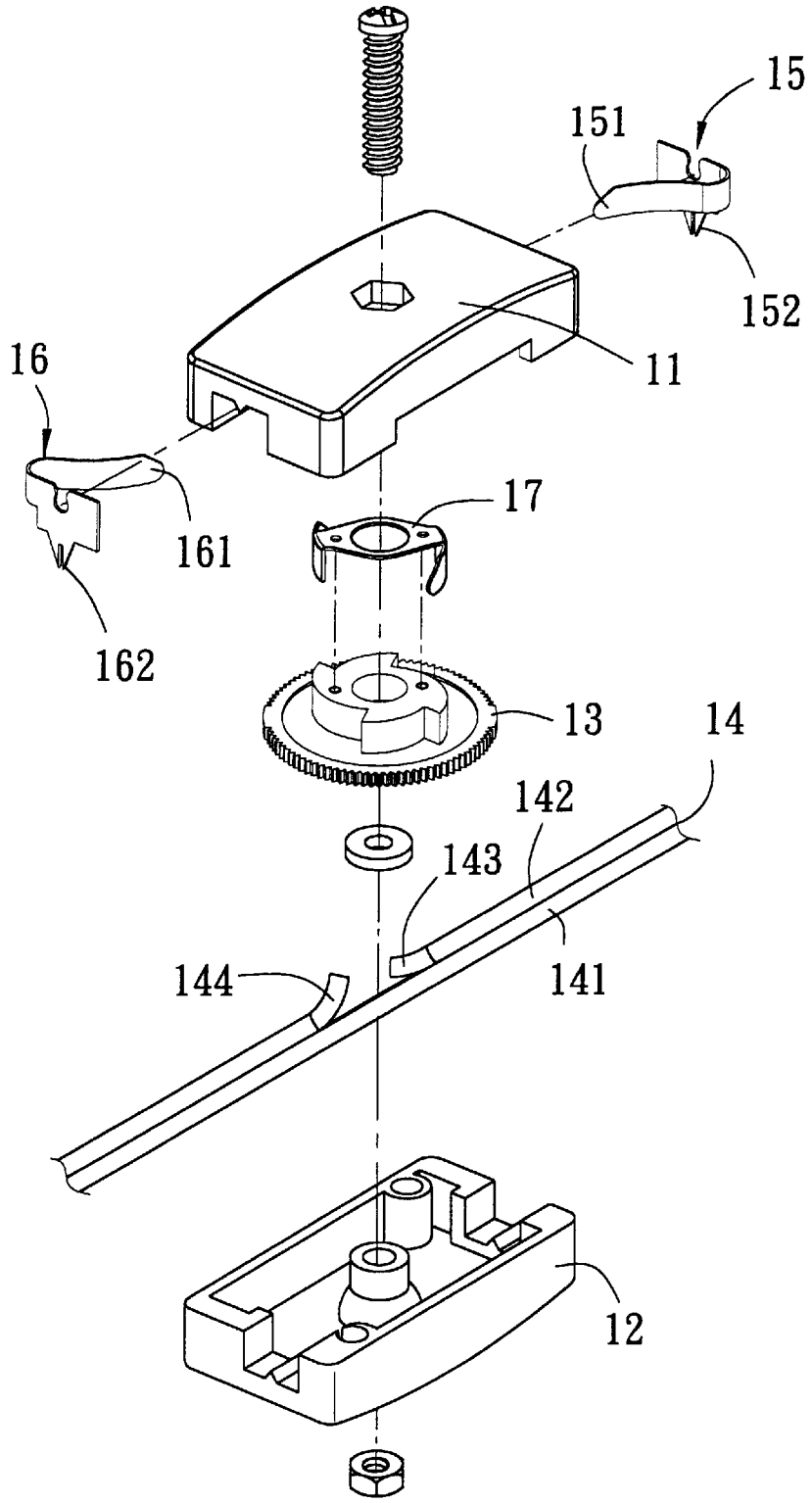
FIG. 1 PRIOR ART
FIG. 1 is an exploded perspective view of a conventional rotary switch.
Figure 2:
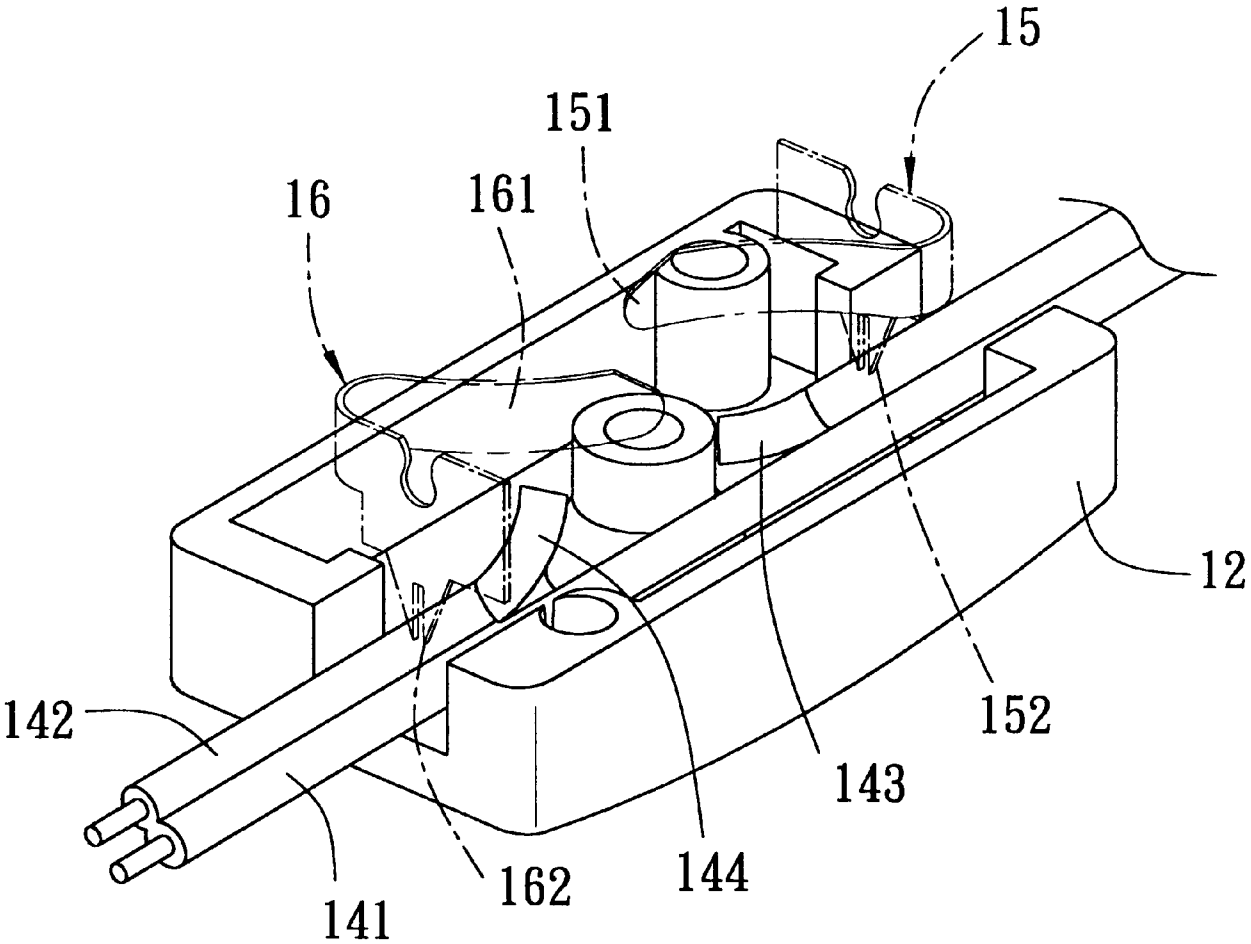
FIG. 2 PRIOR ART
FIG. 2 is a perspective view illustrating how an electrical cable is disposed in a switch housing of the conventional rotary switch.
Figure 3:
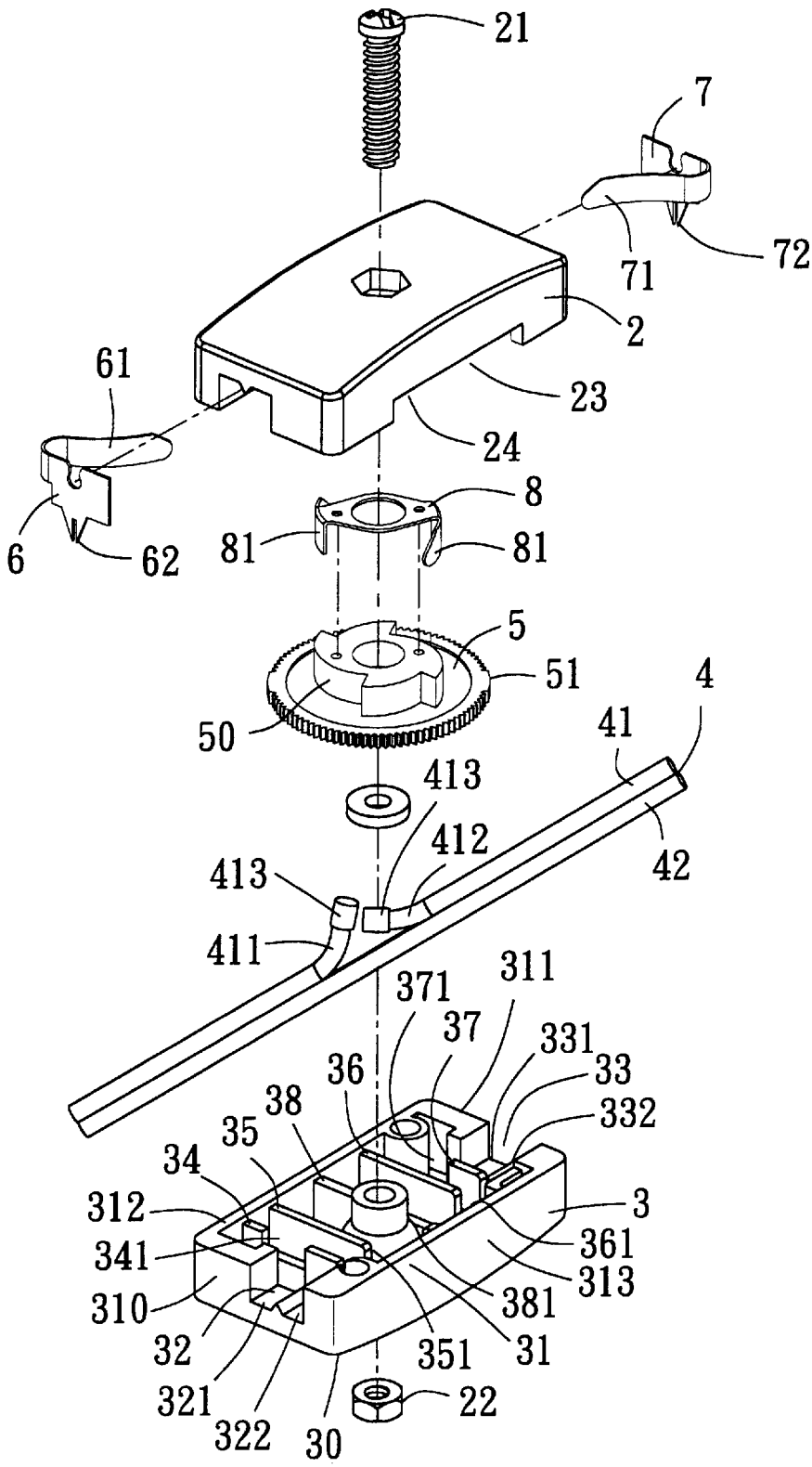
FIG. 3 is an exploded perspective view of the preferred embodiment of a rotary switch according to this invention.
Figure 4:
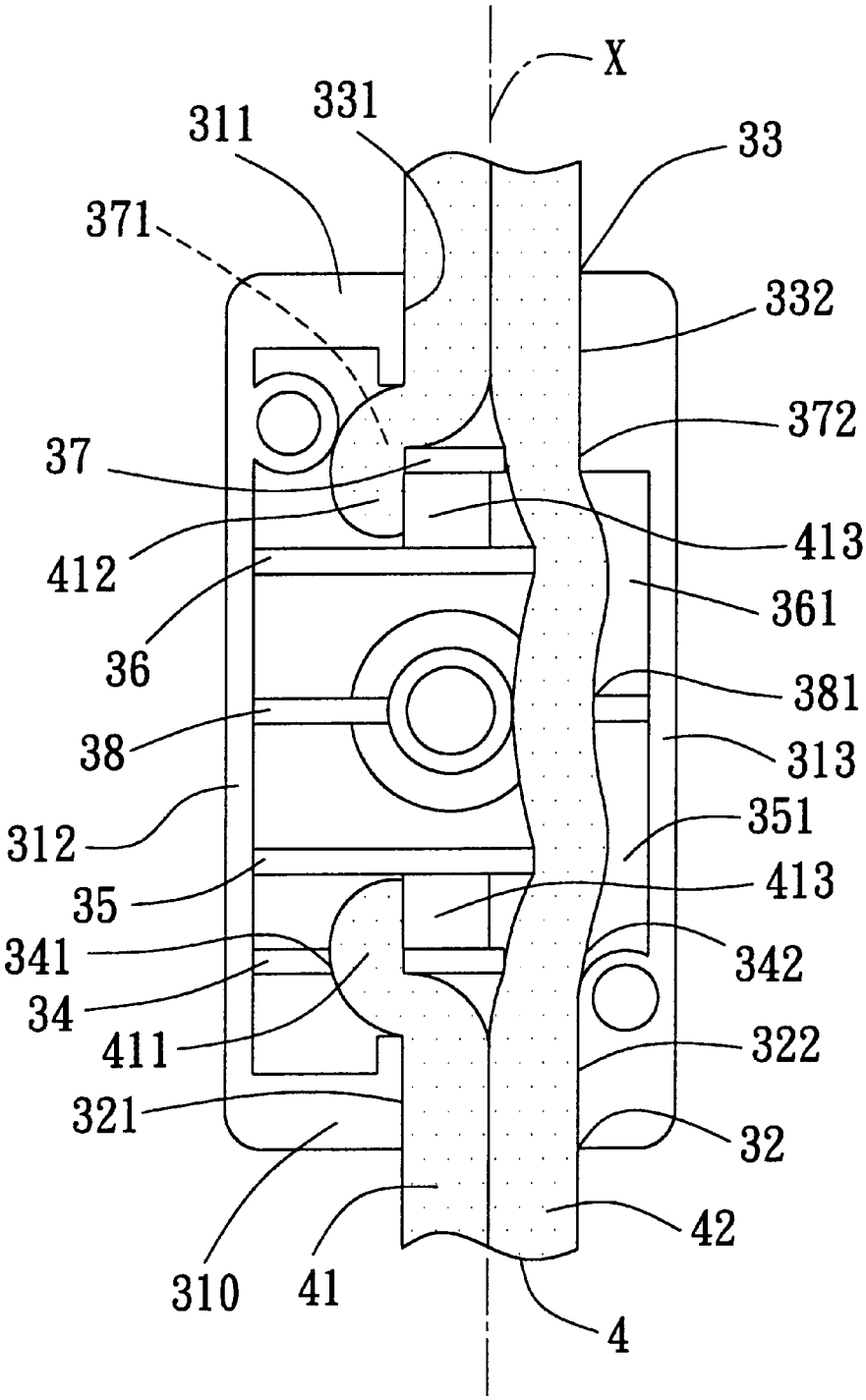
FIG. 4 is a schematic view illustrating how an electrical cable is disposed in a switch housing of the preferred embodiment.

Referring to FIGS. 3 and 4, the preferred embodiment of a rotary switch according to this invention is shown to comprise a rectangular switch housing, a rotary dial 5, a rotary contact 8, and first and second conductive terminals 6, 7.

The switch housing includes complementary upper and lower housing parts 2, 3 that are fastened together by a bolt 21 and a nut 22 and that cooperate to confine a chamber 23. The upper housing part 2 has opposite left and right lateral walls formed respectively with a pair of dial notches 24 for access to the chamber 23. The lower housing part 3 has a rectangular base wall 30 and a surrounding wall 31 that extends upwardly from a periphery of the base wall 30. The surrounding wall 31 has opposite first and second end wall portions 310, 311, and opposite left and right lateral wall portions 312, 313 that interconnect the first and second end wall portions 310, 311. The lower housing part 3 has a longitudinal axis (X). The first and second end wall portions 310, 311 are respectively formed with first and second wire notches 32, 33 that are disposed on the longitudinal axis (X). The first wire notch 32 includes a pair of first notch portions 321, 322 disposed on opposite sides of the longitudinal axis (X). The second wire notch 33 includes a pair of second notch portions 331, 332 disposed on opposite sides of the longitudinal axis (X). One of the first notch portions 321 is aligned longitudinally with one of the second notch portions 331 relative to the longitudinal axis (X). The other one of the first notch portions 322 is aligned longitudinally with the other one of the second notch portions 332 relative to the longitudinal axis (X).

A first barrier 34 extends upwardly from the base wall 30, is parallel to the first end wall portion 310, and is spaced apart from the first end wall portion 310 along the longitudinal axis (X). The first barrier 34 is formed with a first retaining notch 341 that is disposed closer to the left lateral wall portion 312 of the surrounding wall 31 than the longitudinal axis (X), and a second retaining notch 342 that is disposed closer to the right lateral wall portion 313 of the surrounding wall 31 than the longitudinal axis (X).

A second barrier 37 extends upwardly from the base wall 30, is parallel to the second end wall portion 311, and is spaced apart from the second end wall portion 311 along the longitudinal axis (X). The second barrier 37 is formed with a third retaining notch 371 that is disposed closer to the left lateral wall portion 312 than the longitudinal axis (X), and a fourth retaining notch 372 that is disposed closer to the right lateral wall portion 313 than the longitudinal axis (X).

A third barrier 35 extends upwardly from the base wall 30, is parallel to the first barrier 34, is spaced apart from the first barrier 34 along the longitudinal axis (X), and is disposed between the first and second barriers 34, 37. The third barrier 35 is formed with a fifth retaining notch 351 that is disposed closer to the right lateral wall portion 313 than the longitudinal axis (X). The fifth retaining notch 351 is disposed farther from the longitudinal axis (X) than the second retaining notch 342.

A fourth barrier 36 extends upwardly from the base wall 30, is parallel to the second barrier 37, is spaced apart from the second barrier 37 along the longitudinal axis (X), and is disposed between the second and third barriers 37, 35. The fourth barrier 36 is formed with a sixth retaining notch 361 that is disposed closer to the right lateral wall portion 313 than the longitudinal axis (X). The sixth retaining notch 361 is disposed farther from the longitudinal axis (X) than the fourth retaining notch 372.

A fifth barrier 38 extends upwardly from the base wall 30, and is parallel to and is disposed between the third and fourth barriers 35, 36. The fifth barrier 38 is formed with a seventh retaining notch 381 that is disposed closer to the right lateral wall portion 313 than the longitudinal axis (X). The seventh retaining notch 381 is disposed closer to the longitudinal axis (X) than the fifth and sixth retaining notches 351, 361.

A two-wire electrical cable 4 extends longitudinally through the switch housing. The electrical cable 4 includes first and second wires 41, 42. The first wire 41 has a split section to form first and second wire portions 411, 412 inside the switch housing. Each of the first and second wire portions 411, 412 has a distal end fittingly provided with a metal retaining block 413. The first wire portion 411 is extended through the first notch portion 321 and the first retaining notch 341, and is subsequently bent toward the longitudinal axis (X) such that the retaining block 413 thereon can be clamped and fittingly retained between the first and third barriers 34, 35. The second wire portion 412 is extended through the second notch portion 331 and the third retaining notch 371, and is subsequently bent toward the longitudinal axis (X) such that the retaining block 413 thereon can be clamped and fittingly retained between the second and fourth barriers 37, 36. The second wire 42 extends through the first notch portion 322, the second retaining notch 342, the fifth retaining notch 351, the seventh retaining notch 381, the sixth retaining notch 361, the fourth retaining notch 372 and the second right notch portion 332.

The rotary dial 5, which is made of an insulator material, is mounted rotatably in the chamber 23 of the switch housing. The rotary dial 5 includes a dial plate 51 having diametrically opposite edge portions that extend outwardly and respectively of the switch housing via the dial notches 24 in the upper housing part 2, and a contact mounting block 50 formed concentrically on one side of the dial plate 51. The rotary contact 8 is mounted on the contact mounting block 50, and is formed with an opposing pair of contact terminals 81 that extend to a periphery of the contact mounting block 50. The rotary dial 5 is rotatable about the bolt 21 so as to dispose the rotary contact 8 in a selected one of first and second switch positions. The first and second conductive terminals 6, 7 are mounted in the upper housing part 2, and are disposed adjacent to the first and second end wall portions 310, 311 of the lower housing part 3, respectively. The first conductive terminal 6 has a spring arm portion 61 that extends toward the contact mounting block 50 of the rotary dial 5, and a wire connecting portion 62 that pierces through insulation at the first wire portion 411 to connect electrically therewith. The second conductive terminal 7 has a spring arm portion 71 that extends toward the contact mounting block 50 of the rotary dial 5, and a wire connecting portion 72 that pierces through insulation at the second wire portion 412 to connect electrically therewith.

Figure 6:
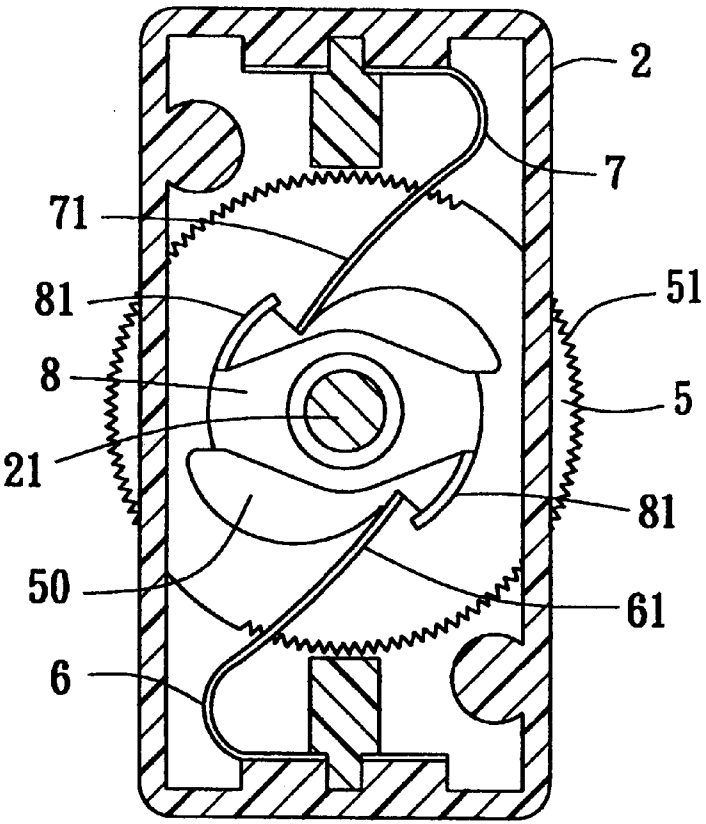
FIG. 6 is a sectional view illustrating the preferred embodiment when the rotary contact is in a second switch position.
Figure 5:
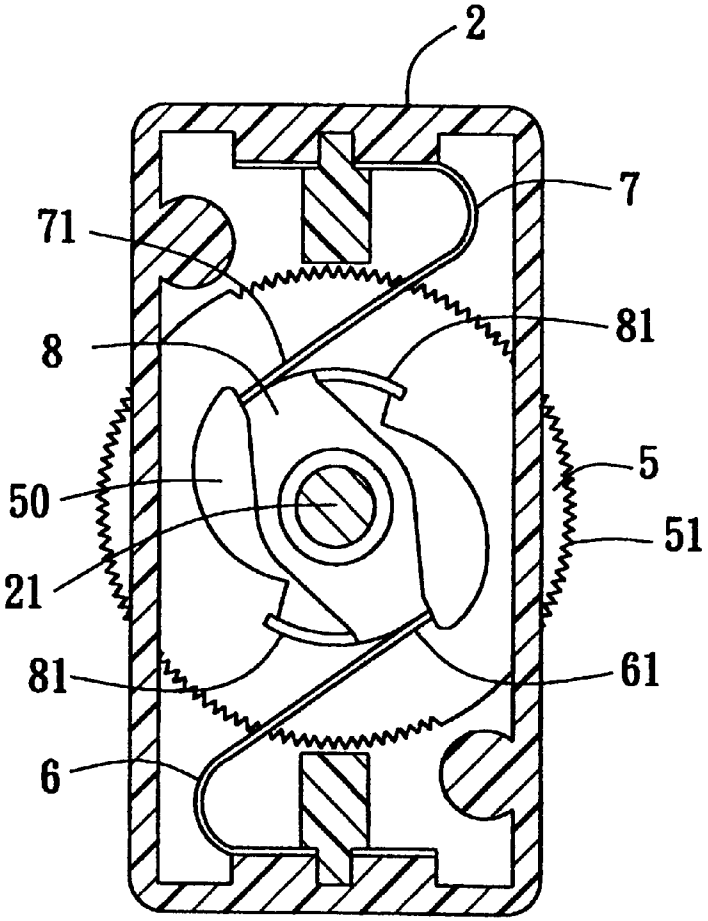
FIG. 5 is a sectional view illustrating the preferred embodiment when a rotary contact thereof is in a first switch position.

Referring to FIG. 5, when the rotary dial 5 is rotated to dispose the rotary contact 8 in the first switch position, the contact terminals 81 of the rotary contact 8 are brought to connect electrically and respectively with the spring arm portions 61, 71 of the first and second conductive terminals 6, 7, thereby permitting current flow through the electrical cable 4. Referring to FIG. 6, when the rotary dial 5 is rotated to dispose the rotary contact 8 in the second switch position, the contact terminals 81 of the rotary contact 8 are moved to disconnect the spring arm portions 61, 71. At this time, the spring arm portions 61, 71 abut respectively against the contact mounting block 50 of the rotary dial 5, which is made of an insulator material, thereby interrupting current flow through the electrical cable 4.

Due to the arrangement of the barriers 34, 37, 35, 36, 38 in the lower housing part 3 of the switch housing, the electrical cable 4 can be prevented from moving relative to the rotary switch of this invention even when the electrical cable 4 is subjected to tensile forces. In an experiment that was conducted to verify the improved effect of the rotary switch according to this invention, it was found that when a tensile force of up to 35 pounds was applied to the electrical cable 4, the detected movement of the electrical cable 4 relative to the rotary switch was less than 1/32 inch. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A rotary switch for a two-wire electrical cable, the electrical cable including first and second wires, the first wire having a split section to form first and second wire portions, said rotary switch comprising:

a switch housing including complementary upper and lower housing parts that are fastened to each other and that cooperate to confine a chamber, one of said housing parts having a base wall and a surrounding wall that extends in a transverse direction from a periphery of said base wall, said surrounding wall having opposite first and second end wall portions, and opposite first and second lateral wall portions that interconnect said first and second end wall portions, said one of said housing parts having a longitudinal axis, said first and second end wall portions of said surrounding wall being respectively formed with first and second wire notches that disposed on said longitudinal axis, said first wire notch including a pair of first notch portions disposed on opposite sides of said longitudinal axis, said second wire notch including a pair of second notch portions disposed on opposite sides of said longitudinal axis, one of said first notch portions being longitudinally aligned with one of said second notch portions relative to said longitudinal axis, the other one of said first notch portions being longitudinally aligned with the other one of said second notch portions relative to said longitudinal axis, said one of said housing parts further having a first barrier that extends from said base wall in the transverse direction, that is parallel to said first end wall portion of said surrounding wall, and that is spaced apart from said first end wall portion along said longitudinal axis, said first barrier being formed with a first retaining notch that is disposed closer to said first lateral wall portion of said surrounding wall than said longitudinal axis, and a second retaining notch that is disposed closer to said second lateral wall portion of said surrounding wall said longitudinal axis, said one of said housing parts further having a second barrier that extends from said base wall in the transverse direction, that is parallel to said second end wall portion of said surrounding wall, and that is spaced apart on said second end wall portion along said longitudinal axis, said second barrier being formed with a third retaining notch that is disposed closer to said first lateral wall portion than said longitudinal axis, and a fourth retaining notch that is disposed closer to said second lateral wall portion than said longitudinal axis, said one of said housing parts further having a third barrier that extends from said base wall in the transverse direction, that is parallel to said first barrier, that is spaced apart from said first barrier along said longitudinal axis, and that is disposed between said first and second barriers, said third barrier being formed with a fifth retaining notch that is disposed closer to said second lateral wall portion than said longitudinal axis, said one of said housing parts further having a fourth barrier that extends from said base wall in the transverse direction, that is parallel to said second barrier, that is spaced apart from said second barrier along said longitudinal axis, and that is disposed between said second and third barriers, said fourth barrier being formed with a sixth retaining notch that is disposed closer to said second lateral wall portion than said longitudinal axis, one of said first notch portions and said first retaining notch being constructed and arranged to permit the first wire portion of the first wire of the electrical cable to extend therethrough and to permit subsequent bending of the first wire portion toward said longitudinal axis, said first and third barriers being constructed and arranged to clamp and retain the first wire portion therebetween, one of said second notch portions and said third retaining notch being constructed and arranged to permit the second wire portion of the first wire of the electrical cable to extend therethrough and to permit subsequent bending of the second wire portion toward sad longitudinal axis, said second and fourth barriers being constructed and arranged to clamp and retain the second wire portion tberebetween, the other one of said first notch portions, said second retaining notch, said fifth retaining notch, said sixth retaining notch, said fourth retaining notch and the other one of said second notch portions being constructed and arranged to permit the second wire of the electrical cable to extend therethrough;

a rotary dial mounted rotatably in said chamber of said switch housing and having an edge portion that extends outwardly of said switch housing;

a rotary contact mounted on said rotary dial and rotatable with said rotary dial between first and second switch positions; and first and second conductive terminals mounted in said switch housing and disposed adjacent to said first and second end wall portions of said surrounding wall, respectively, said first conductive terminal having a wire connecting portion that is constructed and arranged to be connected electrically to the first wire portion, and a spring arm portion that extends toward said rotary dial.

2. The rotary switch of claim 1 wherein:

said fifth retaining notch is disposed farther from said longitudinal axis than said second retaining notch; and said sixth retaining notch is disposed farther from said longitudinal axis than said fourth retaining notch.

3. The rotary switch of claim 2, wherein said one of said housing parts further has a fifth barrier that extends from said base wall in the transverse direction, and that is parallel to and that is disposed between said third and fourth barriers, said fifth barrier being formed with a seventh retaining notch that is disposed closer to said second lateral wall portion of said surrounding wall than said longitudinal axis and that is disposed closer to said longitudinal axis than said fifth and sixth retaining notches, said seventh retaining notch being adapted to permit extension of the second wire of the electrical cable therethrough.

4. The rotary switch of claim 3, wherein:

said rotary dial is made of an insulator material and has one side formed with a contact mounting block, said rotary contact being mounted on said contact mounting block, and having an opposing pair of contact terminals that extend to a periphery of said contact mounting block, said spring arm portions of said first and second conductive terminals contacting said contact terminals of said rotary contact respectively when said rotary contact is disposed in said first switch position, said spring arm portions of said first and second conductive terminals abutting respectively against said contact mounting block of said rotary dial when said rotary contact is disposed in said second switch position.

5. A switch assembly comprising:

a two-wire electrical cable including first and second wires, said first wire having a split section to form first and second wire portions; and a rotary switch including:

a switch housing including complementary upper and lower housing parts that are fastened to each other and that cooperate to confine a chamber, one of said housing parts having a base wall and a surrounding wall that extends in a transverse direction from a periphery of said base wall, said surrounding wall having opposite first and second end wall portions, and opposite first and second lateral wall portions that interconnect said first and second end wall portions, said one of said housing parts having a longitudinal axis, said first and second end wall portions of said surrounding wall being respectively formed with first and second wire notches that are disposed on said longitudinal axis, said first wire notch including a pair of first notch portions disposed on opposite sides of said longitudinal axis, said second wire notch including a pair of second notch portions disposed on opposite sides of said longitudinal axis, one of said first notch portions being longitudinally aligned with one of said second notch portions relative to said longitudinal axis, the other one of said first notch portions being longitudinally aligned with the other one of said second notch portions relative to said longitudinal axis, said one of said housing parts further having a first barrier that extends from said base wall in the transverse direction, that is parallel to said first end wall portion of said surrounding wall, and that is spaced apart from said first end wall portion along said longitudinal axis, said first barrier being formed with a first retaining notch that is disposed closer to said first lateral wall portion of said surrounding wall than said longitudinal axis, and a second retaining notch that is disposed closer to said second lateral wall portion of said surrounding wall than said longitudinal axis, said one of said housing parts further having a second barrier that extends from said base wall in the transverse direction, that is parallel to said second end wall portion of said surrounding wall, and that is spaced apart from said second end wall portion along said longitudinal axis, said second barrier being formed with a third retaining notch that is disposed closer to said first lateral wall portion than said longitudinal axis, and a fourth retaining notch that is disposed closer to said second lateral wall portion than said longitudinal axis, said one of said housing parts further having a third barrier that extends from said base wall in the transverse direction, that is parallel to said first barrier, that is spaced apart from said first barrier along said longitudinal axis, and that is disposed between said first and second barriers, said third barrier being formed with a fifth retaining notch that is disposed closer to said second lateral wall portion than said longitudinal axis, said one of said housing parts further having a fourth barrier that extends from said base wall in the transverse direction, that is parallel to said second barrier, that is spaced apart from said second barrier along said longitudinal axis, and that is disposed between said second and third barriers, said fourth barrier being formed with a sixth retaining notch that is disposed closer to said second lateral wall portion than said longitudinal axis, said first wire portion of said first wire of said electrical cable extending through one of said first notch portions and said first retaining notch and being subsequently bent toward said longitudinal axis, said first wire portion being clamped and retained by said first and third barriers therebetween, said second wire portion of said first wire of said electrical cable extending through one of said second notch portions and said third retaining notch and being subsequently bent toward said longitudinal axis, said second wire portion being clamped and retained by said second and fourth barriers therebetween, said second wire of said electrical cable extending through the other one of said first notch portions, said second retaining notch, said fifth retaining notch, said sixth retaining notch, said fourth retaining notch and the other one of said second notch portions;

a rotary dial mounted rotatably in said chamber of said switch housing and having an edge portion that extends outwardly of said switch housing;

a rotary contact mounted on said rotary dial and rotatable with said rotary dial between first and second switch positions; and first and second conductive terminals mounted in said switch housing and disposed adjacent to said first and second end wall portions of said surrounding wall, respectively, said first conductive terminal having a wire connecting portion that is connected electrically to said first wire portion, and a spring arm portion that extends toward said rotary dial, said second conductive terminal having a wire connecting portion that is connected electrically to said second wire portion, and a spring arm portion that extends toward said rotary dial, said rotary contact connecting electrically said first and second conductive terminals when said rotary contact is disposed in said first switch position, and disconnecting said first and second conductive terminals when said rotary contact is disposed in said second switch position.

6. The switch assembly of claim 5, wherein:

said fifth retaining notch is disposed farther from said longitudinal axis than said second retaining notch; and said sixth retaining notch is disposed farther from said longitudinal axis than said fourth retaining notch.

7. The switch assembly of claim 6, wherein said one of said housing parts further has a fifth barrier that extends from said base wall in the transverse direction, and that is parallel to and that is disposed between said third and fourth barriers, said fifth barrier being formed with a seventh retaining notch that is disposed closer to said second lateral wall portion of said surrounding wall than said longitudinal axis and that is disposed closer to said longitudinal axis than said fifth and sixth retaining notches, said second wire of said electrical cable further extending through said seventh retaining notch.

8. The switch assembly of claim 5, wherein:

said first wire portion has a distal end provided with a retaining block that is clamped and retained by said first and third barriers; and said second wire portion has a distal end provided with a retaining block that is clamped and retained by said second and fourth barriers.

* * * * *